US007861770B2

(12) United States Patent
Ascanio Milano et al.

(10) Patent No.: US 7,861,770 B2
(45) Date of Patent: Jan. 4, 2011

(54) SYSTEM FOR CYCLIC INJECTION AND PRODUCTION FROM A WELL

(75) Inventors: Felix Antonio Ascanio Milano, Rijswijk (NL); Alexander Michiel Mollinger, Rijswijk (NL); Eric Pierre de Rouffignac, Rijswijk (NL)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 12/063,005

(22) PCT Filed: Jul. 18, 2006

(86) PCT No.: PCT/EP2006/064386

§ 371 (c)(1),
(2), (4) Date: Jun. 30, 2008

(87) PCT Pub. No.: WO2007/017353

PCT Pub. Date: Feb. 15, 2007

(65) Prior Publication Data

US 2008/0302522 A1 Dec. 11, 2008

(30) Foreign Application Priority Data

Aug. 9, 2005 (EP) ..... 05107316

(51) Int. Cl.
*E21B 36/00* (2006.01)
*E21B 43/24* (2006.01)

(52) U.S. Cl. ..... 166/57; 166/263; 166/303; 166/306

(58) Field of Classification Search ..... 166/303, 166/306, 263, 269, 57
See application file for complete search history.

(56) References Cited

U.S. PATENT DOCUMENTS

| | | | | |
|---|---|---|---|---|
| 3,361,202 | A * | 1/1968 | Whipple | 166/272.3 |
| 5,080,172 | A | 1/1992 | Jones et al. | 166/303 |
| 5,289,881 | A | 3/1994 | Schuh et al. | 166/303 |
| 5,626,193 | A | 5/1997 | Nzekwu et al. | 166/303 |
| 5,865,249 | A | 2/1999 | Gipson et al. | 166/50 |
| 6,158,510 | A | 12/2000 | Bacon et al. | 166/272.7 |
| 6,481,500 | B1 | 11/2002 | Burd et al. | 166/269 |
| 6,481,503 | B2 * | 11/2002 | Hamilton et al. | 166/313 |
| 6,675,893 | B2 * | 1/2004 | Lund | 166/278 |

FOREIGN PATENT DOCUMENTS

| | | |
|---|---|---|
| GB | 2379685 | 3/2003 |
| WO | WO9837306 | 8/1998 |

OTHER PUBLICATIONS

Yildiz, T.: "Productivity of Horizontal Wells Completed with Screens", SPE 76712.

* cited by examiner

*Primary Examiner*—Giovanna C Wright
(74) *Attorney, Agent, or Firm*—William E. Hickman

(57) ABSTRACT

A system is provided for injecting an injection fluid into an earth formation via a wellbore formed in the earth formation and for producing hydrocarbon fluid from the earth formation via the wellbore. The system comprises an injection conduit extending into the wellbore and being in fluid communication with a plurality of outlet ports for injection fluid, and a production conduit extending into the wellbore and being in fluid communication with at least one inlet section for hydrocarbon fluid. The injection conduit is arranged to prevent fluid communication between the injection conduit and each said inlet section.

11 Claims, 4 Drawing Sheets

SYSTEM FOR CYCLIC INJECTION AND PRODUCTION FROM A WELL

PRIORITY CLAIM

Figure 1:
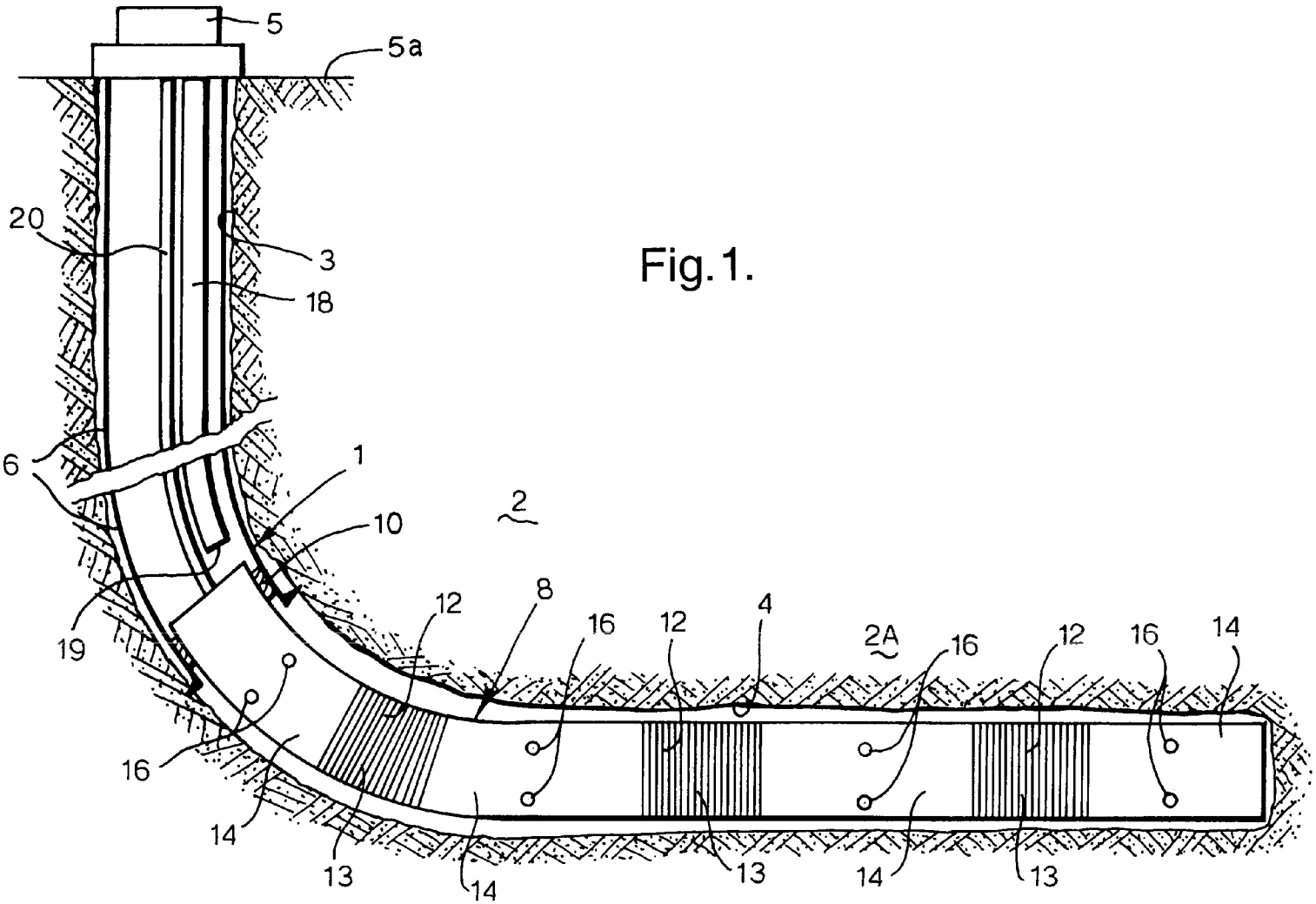

The present application claims priority to European Patent Application 05107316.1 filed Aug. 9, 2005.

FIELD OF THE INVENTION

The present invention relates to a system for injecting an injection fluid into an earth formation via a wellbore formed in the earth formation and for producing hydrocarbon fluid from the earth formation via the wellbore. The injection fluid can be, for example, steam that is injected into the formation at high temperature and pressure to lower the viscosity of heavy oil present in the formation so as to enhance the flow of the oil through the pores of the formation during the production phase. In one such application, steam is injected through one or more injector wells drilled in the vicinity of one or more production wells, and oil is produced from the production wells.

BACKGROUND OF THE INVENTION

Instead of using separate wells for steam injection and oil production, a single well can be used for the injection of steam and the production of oil. In such operation the injection of steam and the production of oil occur in a cyclic mode generally referred to as Cyclic Steam Simulation (CSS) process. In the CSS process, the well is shut in and steam is injected through the well into the oil-bearing formation to lower the viscosity of the oil. During a next stage, oil is produced from the formation through the same well. In order that the steam is injected substantially uniformly along the portion of the well penetrating the reservoir zone, i.e. without a concentration of injected steam at one location at the cost of another location, the steam is generally pumped through spaced outlet ports having a relatively small diameter, generally referred to as Limited Entry Perforations (LEP). This is done to ensure that the steam exits the outlet ports at a velocity approaching sonic velocity and is therefore choked or throttled. The size of the outlet ports typically is of the order of 0.5-1.0 inch.

U.S. Pat. No. 6,158,510 suggests a wellbore liner for CSS including a base pipe provided with a plurality of LEP ports spaced in longitudinal direction and circumferential direction of the liner. The liner is provided with several sandscreens spaced along the liner, each sandscreen extending around the base pipe at short radial distance therefrom. During each steam injection cycle, the well is shut in and steam is injected into the rock formation via the LEP ports. The steam flows through the LEP ports at sub-critical velocity so that the flow rate of steam in the LEP ports is independent from pressure variations downstream the ports, thus ensuring a uniform outflow of steam along the liner. After a period of steam injection, a production cycle is started whereby oil from the surrounding rock formation flows via the LEP ports into the liner and from there to a production facility at surface.

It is a drawback of the known system that, during the production cycle, the volumetric flow rate of oil through the LEP ports is relatively low. The amount of oil produced from the well in a given period of time is therefore also low.

U.S. Pat. No. 5,865,249. discloses a system configured to flush debris from the bottom of a wellbore by injecting water via a water injection conduit into the plugged zone and inducing the debris to flow up through the wellbore through the production conduit.

SUMMARY OF THE INVENTION

In accordance with the invention there is provided a system for injecting an injection fluid into an earth formation via a wellbore formed in the earth formation and for producing hydrocarbon fluid from the earth formation via the wellbore, the system comprising an injection conduit extending into the wellbore and being in fluid communication with a plurality of outlet ports for injection fluid, the system further comprising a production conduit extending into the wellbore and being in fluid communication with at least one inlet section for hydrocarbon fluid, wherein the injection conduit is arranged to prevent fluid communication between the injection conduit and each said inlet section, characterised in that the injection fluid is a heated fluid which is injected into the formation in order to reduce the viscosity of hydrocarbon fluids within the formation.

By virtue of the feature that the injection conduit is arranged to prevent fluid communication between the injection conduit and each inlet section, it is achieved that the injection fluid can be injected through the LEP ports of small size, whereas oil can be produced through each inlet section of a much larger size. Suitably the injection conduit and the production conduit are separate conduits.

Furthermore, it is preferred that the outlet ports are comprised in a plurality of series of outlet ports, wherein the system comprises a plurality of said inlet sections, and wherein said inlet sections and said series of outlet ports are arranged in alternating order in longitudinal direction of the wellbore. In this manner it is achieved that injection fluid is injected at locations along the liner inbetween the inlet sections thereby ensuring substantially uniform heating of the rock formation along the length of the liner.

The invention will be described hereinafter in more detail by way of example, with reference to the accompanying drawings in which:

BRIEF DESCRIPTION OF THE INVENTION

Figure 2:
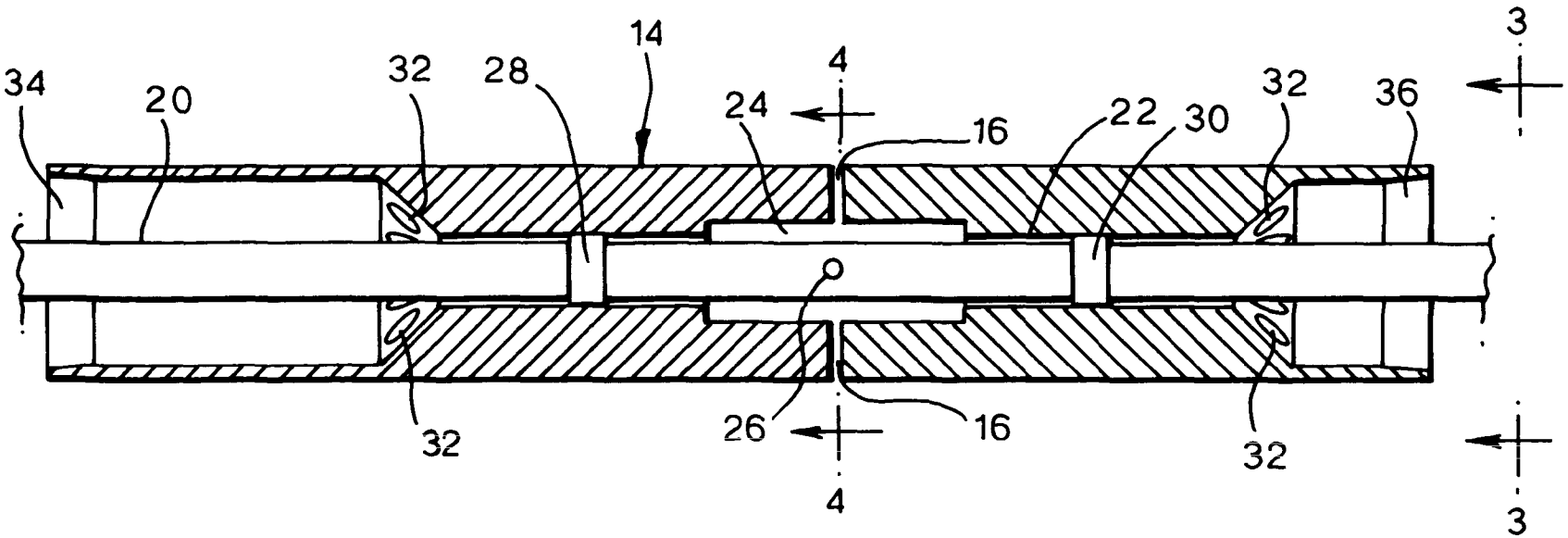
Figure 3:
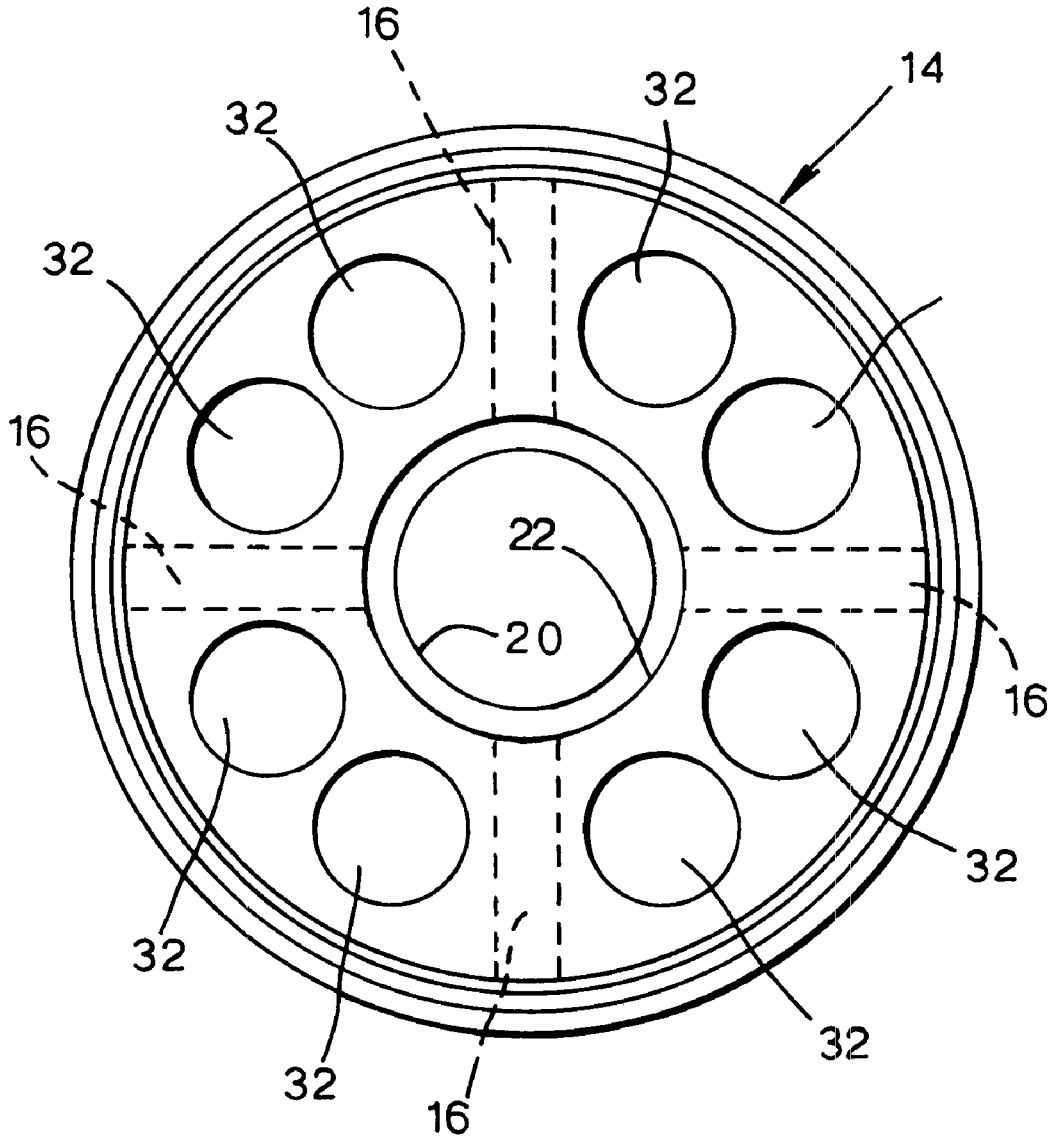

FIG. 1 schematically shows a wellbore for the production of hydrocarbon fluid from an earth formation, provided with an embodiment of the system of the invention;

FIG. 2 schematically shows a portion of a liner used in the system of FIG. 1;

FIG. 3 schematically shows side view 3-3 of FIG. 2; and

Figure 4:
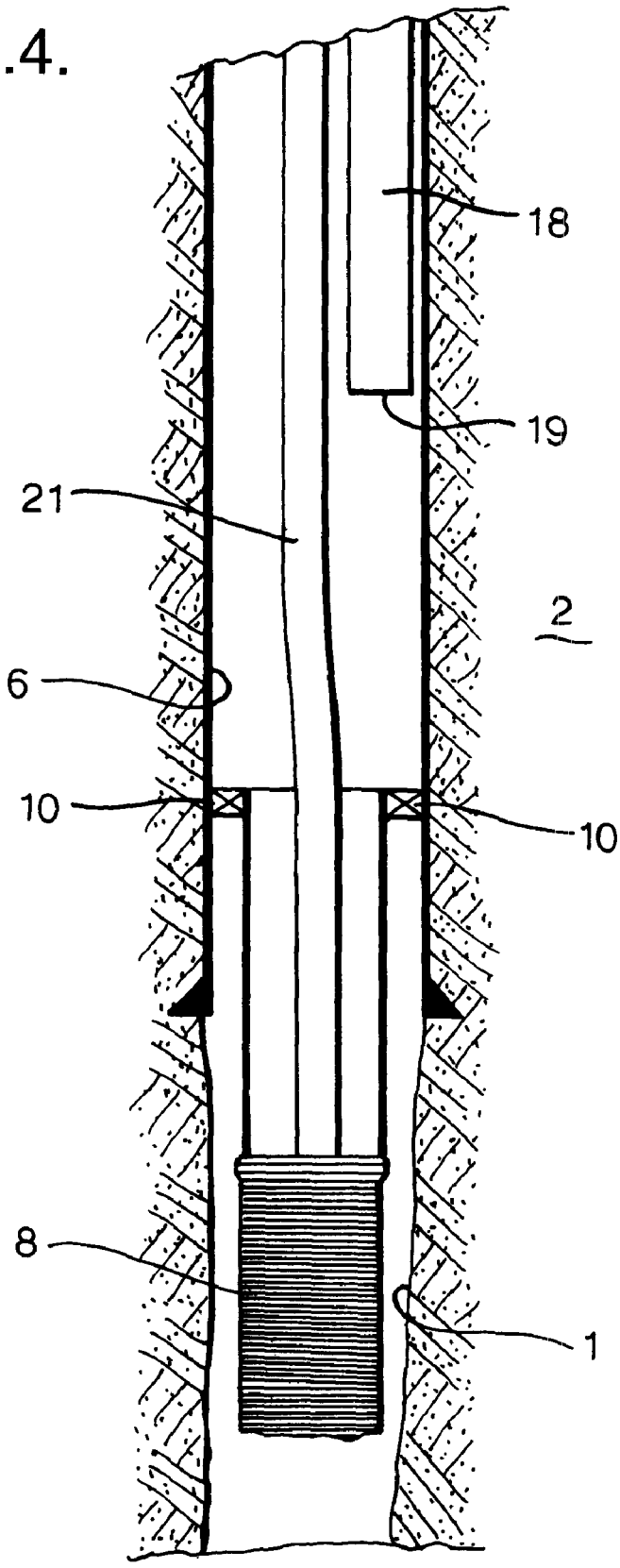

FIG. 4 schematically shows an upper portion of the liner used in the system of FIG. 1.

DETAILED DESCRIPTION OF THE INVENTION

In the Figures like reference numerals relate to like components.

Referring to FIG. 1 there is shown a wellbore 1 for the production of hydrocarbon oil and gas from an earth formation 2. The wellbore 1 has an upper section 3 extending substantially vertical and a lower section 4 extending substantially horizontal. A wellhead 5 is arranged at the earth surface 5*a* above the well 1. The lower wellbore section 4 penetrates a reservoir zone 2A of the earth formation 2. A conventional casing 6 extends from surface into the vertical wellbore section 3, and a production liner 8 extends from the lower end of the casing 6 into the horizontal wellbore section 4. A packer 10 seals the outer surface of the liner 8 relative to the inner surface of the casing 6. The liner 8 comprises a plurality of inlet sections in the form of tubular sandscreens 12 for reducing inflow of solid particles, and a plurality of tubular bodies 14. As is shown in FIG. 1, the screens 12 and the tubular bodies are arranged in alternating order in the horizontal wellbore section 4. Each tubular body 14 is provided with a series of outlet ports 16 of relatively small diameter for injection of fluid into the reservoir zone 2A of the earth formation 2. As discussed hereinbefore, outlet ports of this type are referred to as Limited Entry Perforations (LEP) which limit the flow rate of injection fluid into a zone at a given injection pressure by virtue of the fact that the velocity of injection fluid exiting the outlet ports approaches the sonic velocity. The outlet ports 16 of a series are regularly spaced in circumferential direction of the tubular body 14.

The sandscreens 12 are of conventional type, including a perforated base pipe (not shown) and a tubular filter layer 13 extending around the perforated base pipe. The base pipe of each sandscreen 12 is connected to the respective tubular bodies 14 adjacent the base pipe by conventional screw connectors (not shown) or by any other suitable means, for example by welding.

The wellbore 1 is further provided with a production conduit 18 for the transportation of produced hydrocarbon fluid through the wellbore 1 to surface, the conduit 18 having an inlet opening 19 near the upper end of the liner 8, and an injection conduit in the form of a coiled tubing 20 for the injection of injection fluid into the reservoir zone 2A of the earth formation 2.

Reference is further made to FIG. 2 in which one of the tubular bodies 14 is shown in longitudinal section. The tubular body 14 is provided with a central through-passage 22 extending in longitudinal direction, the through-passage 22 having a mid-portion of enlarged diameter forming a chamber 24 that is in fluid communication with the exterior of the tubular body 14 by means of the outlet ports 16. The coiled tubing 20 extends through the through-passage 22 and has a slightly smaller outer diameter than the diameter of the through-passage 22 so as to allow the coiled tubing to slide through the through-passage 22. The coiled tubing 20 has one or more outlet openings 26 debouching in the chamber 24 of the tubular body 14. Annular seals 28, 30 are provided at either side of the chamber 24 to seal the coiled tubing 20 relative to the passage 22.

Thus, the coiled tubing 20 passes through the liner 8, with the openings 26 being located in the respective chambers 24 of the tubular bodies 14. A plug (not shown) closes the lower end of the coiled tubing 20 at a location below the chamber 24 of the lowermost tubular body 14.

Referring further to FIG. 3 there is shown a side view of the tubular body 14 that is provided with a series of through-bores in the form of production ports 32 fluidly connecting the respective ends 34, 36 (FIG. 2) of the tubular body 14. As shown, the production ports 32 are regularly spaced in circumferential direction of the tubular body 14. The outlet ports 16 for injection fluid (indicated in phantom in FIG. 3) do not intersect the production ports 32.

In FIG. 4 is shown the upper end of the liner 8 extending into the casing 6, with the packer 10 sealing the upper end of the liner 8 relative to the casing 6. As shown, the inlet opening 19 of the production conduit 18 is located in the lower end part of the casing 6.

During a first stage of normal operation, the well 1 is shut in and an injection fluid, such as high temperature steam, is pumped at surface into the coiled tubing 20 by means of a suitable injection facility (not shown). The steam flows downwardly through the coiled tubing 20, and via the outlet openings 26 into respective chambers 24 of the tubular bodies 14. Leakage of steam along the through-passages 22 of the tubular bodies 14 is prevented by the annular seals 28. From the chambers 24, the steam flows through the outlet ports 16 and into the wellbore 1. From there, the steam flows into the reservoir zone 2A of the surrounding earth formation 2. As discussed before, the outlet ports 16 are Limited Entry Perforations (LEP) which have a relatively small diameter so as to limit the flow rate of steam through the outlet ports 16. The pressure at which the steam is injected into the coiled tubing 20 is sufficiently high to ensure that the flow rate of steam in the outlet ports 16 approaches sonic velocity, so that the flow rates are independent of pressure differences downstream the outlet ports 16. It is thus achieved that the steam is substantially uniformly distributed over the various outlet ports 16, and that increased flow through one port 16 at the cost of another port 16 is prevented. The steam heats the reservoir zone 2A whereby the viscosity of the oil in the reservoir zone 2A is lowered.

During a second stage of normal operation, after a period of continued steam injection into the reservoir zone 2*a*, the injection of steam is stopped. The coiled tubing 20 is then retrieved from the wellbore 1 or, alternatively, can remain in the wellbore 1 for the next cycle of steam injection. The well 1 is then opened to start oil production from the reservoir zone 2A, whereby the oil flows into the sandscreens 12 and, from there, via the production ports 32 of the respective tubular bodies 14 towards the production conduit 18. The oil enters the production conduit 18 at its inlet opening 19, and flows to surface to a suitable production facility (not shown). It will be understood that injected steam initially flows back into the well 1 before oil starts flowing into the well 1.

Thus, by the separate arrangement of production conduit 18 and the injection conduit 20 it is achieved that the production of oil is not limited to inflow of oil through the small outlet ports 16 for injection fluid. Instead, oil is produced at flow rates comparable to oil production from wells that do not require injection of steam into the formation.

After a period of continued oil production from the well 1, a next cycle of steam injection is started. The coiled tubing 20 is to be re-installed in the well 1 in case it was retrieved from the well 1 after the previous steam injection cycle. The aforementioned first and second stages of operation are then repeated in cyclic order.

What is claimed is:

1. A system for injecting an injection fluid into a wellbore formed in the earth formation and for producing hydrocarbon fluid from the earth formation via the wellbore, the system comprising:

an injection conduit extending into the wellbore and being in fluid communication with a plurality of outlet ports for injection fluid, a production conduit extending into the wellbore and being in fluid communication with at least one inlet section for hydrocarbon fluid, wherein the injection conduit is arranged to prevent fluid communication between the injection conduit and each said inlet section, wherein the injection fluid is a heated fluid which is injected into the formation in order to reduce the viscosity of hydrocarbon fluids within the formation;

said outlet ports are comprised in a plurality of series of outlet ports;

the system comprises a plurality of said inlet sections; and said inlet sections and said series of outlet ports are arranged in a single reservoir zone in alternating order in longitudinal direction of the wellbore.

2. The system of claim 1, wherein the injection conduit and the production conduit are separate conduits.

3. The system of claim 1, further comprising, for each pair of adjacent inlet sections, a respective tubular body extending between the inlet sections of the pair, each tubular body being provided with one said series of outlet ports.

4. The system of claim 3, wherein the injection conduit extends through a longitudinal passage formed in the tubular body, each outlet port of the series of outlet ports being in fluid communication with the injection conduit via said longitudinal passage.

5. The system of claim 4, wherein each outlet port of the series of outlet ports is in fluid communication with the injection conduit via a portion of enlarged diameter of said longitudinal passage.

6. The system of claim 5, wherein the injection conduit has an outlet opening debauching in said portion of enlarged diameter.

7. The system of claim 5, wherein the injection conduit is capable of sliding in axial direction through the longitudinal passage.

8. The system of claim 3, wherein the tubular body is provided with at least one production port passing in longitudinal direction through the tubular body, each production port providing fluid communication between the production conduit and at least one of said inlet sections.

9. The system of claim 8, wherein the tubular body is provided with a plurality of said production ports mutually spaced in circumferential direction of the tubular element.

10. The system of claim 3, wherein the inlet sections of the pair of adjacent inlet section are connected to the tubular body.

11. The system of claim 1, wherein each said inlet section comprises a screen for preventing or reducing inflow of solid particles into the production conduit.

* * * * *